US009384634B2

(12) United States Patent
Aoki et al.

(10) Patent No.: US 9,384,634 B2
(45) Date of Patent: Jul. 5, 2016

(54) WAGERING GAME EMPLOYING A THRESHOLD-BASED GAME ENHANCEMENT

(71) Applicant: WMS Gaming Inc., Waukegan, IL (US)

(72) Inventors: Dion K. Aoki, Chicago, IL (US); Pamela S. Smith, Chicago, IL (US); Noel Steere, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 223 days.

(21) Appl. No.: 13/760,229

(22) Filed: Feb. 6, 2013

(65) Prior Publication Data

US 2014/0179396 A1 Jun. 26, 2014

Related U.S. Application Data

(60) Provisional application No. 61/745,276, filed on Dec. 21, 2012.

(51) Int. Cl.
*A63F 9/24* (2006.01)
*G07F 17/32* (2006.01)

(52) U.S. Cl.
CPC ..... *G07F 17/3267* (2013.01)

(58) Field of Classification Search
CPC ..... G07F 17/3267
See application file for complete search history.

(56) References Cited

U.S. PATENT DOCUMENTS 6,517,433 B2 2/2003 Loose et al.
7,258,611 B2 * 8/2007 Bigelow et al. ..... 463/25
7,704,137 B2 4/2010 Englman
7,749,073 B2 7/2010 Thomas et al.
7,753,769 B2 7/2010 Gomez et al.
7,819,737 B2 10/2010 Englman et al.
8,157,641 B2 4/2012 Englman et al.
8,187,079 B2 5/2012 Gomez et al.
2005/0054429 A1 3/2005 Baerlocher
2006/0046833 A1 * 3/2006 Hatakeyama et al. ..... 463/20
2007/0021182 A1 * 1/2007 Gauselmann ..... 463/16

(Continued)

FOREIGN PATENT DOCUMENTS

AU 2013200430 8/2013
AU 2013224656 4/2014

OTHER PUBLICATIONS

Australian Office Action for Australian Application No. AU2013202677, mailed Apr. 17, 2015, 3 pages.

*Primary Examiner* — Pierre E Elisca
*Assistant Examiner* — Carl V Larsen
(74) *Attorney, Agent, or Firm* — Nixon Peabody LLP

(57) ABSTRACT

A gaming method of conducting a wagering game includes conducting one or more successive plays of the wagering game via one or more display devices in response to a triggering event. For each of the one or more successive plays, the method includes determining one or more award amounts based on the displayed outcomes of the one or more successive plays. The method further includes aggregating, via one or more processors, each of the one or more award amounts determined over the successive plays to calculate an aggregate award amount and determining, via at least one of the one or more processors, whether the aggregate award amount is greater than a threshold amount. The method includes providing an enhancement to the wagering game in response to the aggregate award amount being greater than the threshold amount.

22 Claims, 12 Drawing Sheets

(56) References Cited

U.S. PATENT DOCUMENTS

| | | | | |
|---|---|---|---|---|
| 2009/0011826 | A1* | 1/2009 | Acres | 463/27 |
| 2009/0042645 | A1* | 2/2009 | Graham et al. | 463/27 |
| 2009/0124330 | A1* | 5/2009 | Leger | 463/20 |
| 2009/0227362 | A1* | 9/2009 | Kelly et al. | 463/25 |
| 2010/0069160 | A1 | 3/2010 | Barrett et al. | |
| 2010/0120493 | A1* | 5/2010 | Hoffman et al. | 463/20 |
| 2010/0234099 | A1 | 9/2010 | Rasmussen et al. | |
| 2012/0108319 | A1* | 5/2012 | Caputo et al. | 463/25 |
| 2012/0270641 | A1* | 10/2012 | Baerlocher et al. | 463/25 |
| 2012/0295689 | A1* | 11/2012 | Owen et al. | 463/20 |
| 2013/0157733 | A1* | 6/2013 | Thorne et al. | 463/1 |
| 2013/0184045 | A1* | 7/2013 | Vermaak et al. | 463/20 |
| 2014/0087855 | A1* | 3/2014 | Caputo et al. | 463/26 |

* cited by examiner

| Triggering Event | Game Enhancement |
|---|---|
| 3 x Cherry | 2X Multiplier |
| 4 x Cherry | 3X Multiplier |
| 3 x Cherry + max bet | 3X Multiplier |
| 4 x Cherry + max bet | 4X Multiplier |

FIG. 7

| Triggering Event | Game Enhancement |
|---|---|
| 3 x Cherry | 60% chance of 2X Multiplier<br>30% chance of 3X Multiplier<br>10% chance of 4X Multiplier |
| 3 x Cherry + max bet | 40% chance of 2X Multiplier<br>40% chance of 3X Multiplier<br>20% chance of 4X Multiplier |
| 4 x Cherry | 1/3 chance of 2X Multiplier<br>1/3 chance of 3X Multiplier<br>1/3 chance of 4X Multiplier |
| 4 x Cherry + max bet | 20% chance of 2X Multiplier<br>30% chance of 3X Multiplier<br>50% chance of 4X Multiplier |

FIG. 8

| Triggering Event | Terminating Event |
|---|---|
| 3 x Cherry | 5 spins |
| 4 x Cherry | 10 spins |
| 3 x Cherry + max bet | 15 spins |
| 4 x Cherry + max bet | 3 minutes |

FIG. 9

WAGERING GAME EMPLOYING A THRESHOLD-BASED GAME ENHANCEMENT

CROSS-REFERENCE TO RELATED APPLICATIONS

This application claims the benefit of and priority to U.S. Provisional Patent Application No. 61/745,276, titled "Wagering Game Employing A Threshold-Based Game Enhancement" and filed on Dec. 21, 2012, which is incorporated herein by reference in its respective entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus and methods and, more particularly, to a wagering game employing a threshold-based game enhancement.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

SUMMARY OF THE INVENTION

According to one aspect of the invention, a computer-implemented method for conducting a wagering game includes determining, via at least one of one or more processors, whether a triggering event has occurred and, in response to determining that a triggering event has occurred, conducting one or more successive plays of the wagering game and displaying respective outcomes of the successive plays via one or more display devices. For each of the one or more successive plays, the method further includes determining, via at least one of the one or more processors, one or more award amounts based on the outcomes of the one or more successive plays and aggregating, via at least one of the one or more processors, each of the one or more award amounts determined over the successive plays to calculate an aggregate award amount. The method also includes determining, via at least one of the one or more processors, whether the aggregate award amount is greater than a threshold amount and, providing an enhancement to the wagering game in response to the aggregate award amount being greater than the threshold amount.

According to another aspect of the invention, a method of conducting a wagering game includes receiving, via one or more input devices, an input indicative of a wager, displaying, via one or more display devices, a plurality of symbols along one or more paylines to indicate a randomly selected outcome of a wagering game in a display area, and determining one or more award amounts for the one or more paylines. Each award amount is based on the wager and the symbols of the randomly selected outcome along a respective one of the one or more paylines. The method also includes determining an aggregate award amount based on the one or more award amounts, comparing the aggregate award amount to a threshold amount, and applying an enhancement to the wagering game based on the comparing of the aggregate award amount and the threshold amount.

According to another aspect of the present invention, a gaming system comprises one or more input devices, one or more display devices, and one or more processors. The system also includes one or more memory devices storing instructions that, when executed by the one or more processors, cause the gaming system to receive, via at least one of the one or more input devices, one or more inputs indicative of one or more respective wagers, display, via at least one of the one or more display devices, one or more randomly selected outcomes of a wagering game, evaluate, via at least one of the one or more processors, each of the one or more randomly selected outcomes to determine one or more award amounts, aggregate, via at least one of the one or more processors, the one or more award amounts to determine an aggregate award amount, determine whether the aggregate award amount is greater than a threshold amount, and, if the aggregate award amount is determined to be greater than the threshold amount, provide an enhancement to the wagering game.

According to yet another aspect of the invention, computer readable storage media is encoded with instructions for directing a gaming system to perform the above methods.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

FIG. 7 is an exemplary table of triggering events and game enhancements in accord with at least some aspects of the disclosed concepts.

FIG. 8 is an exemplary table of triggering events and game enhancements in accord with at least some aspects of the disclosed concepts.

FIG. 9 is an exemplary table of triggering events and terminating events in accord with at least some aspects of the disclosed concepts.

Figure 1:
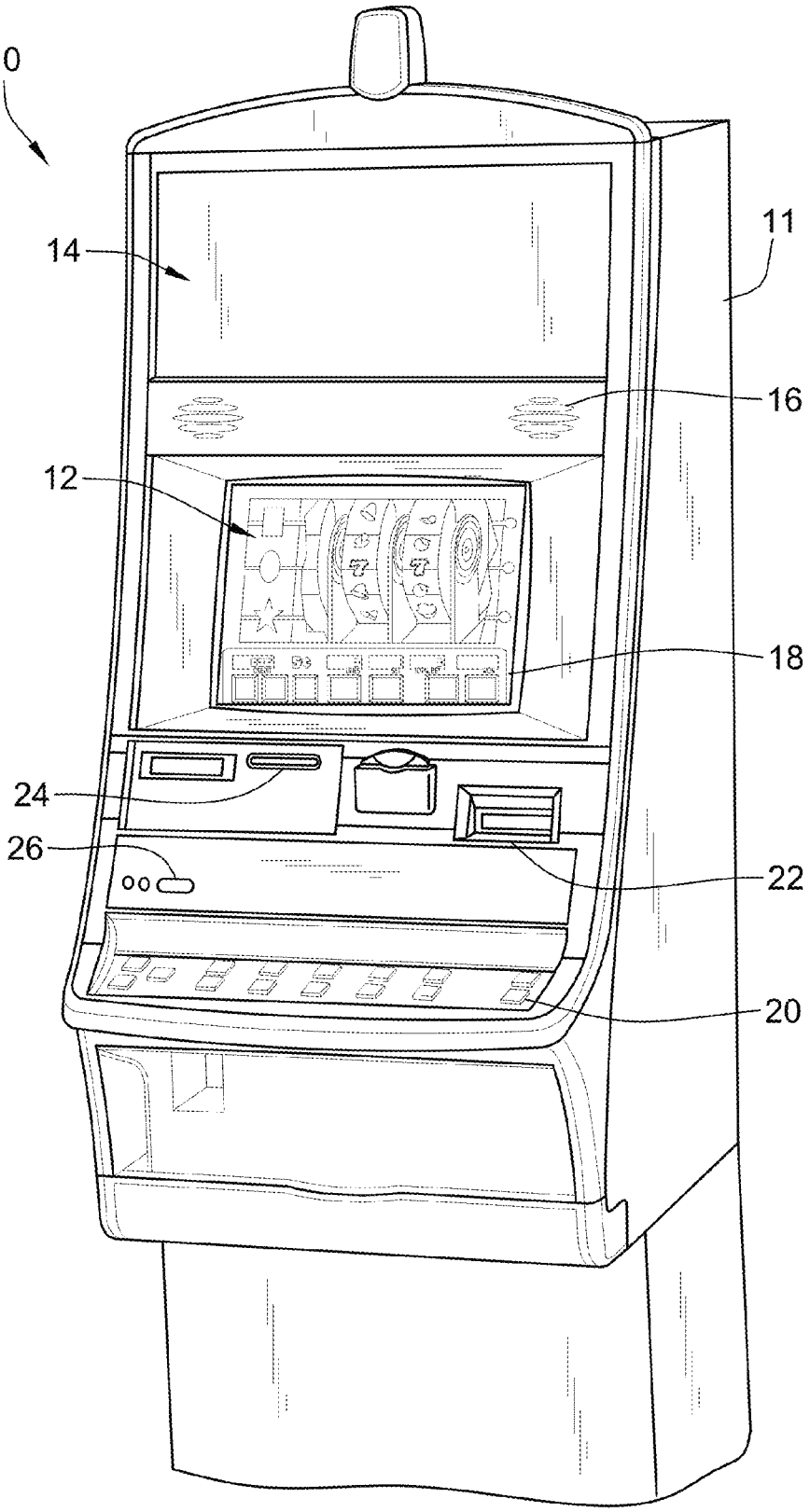
FIG. 1 (PRIOR ART)
FIG. 1 is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433, titled "Reel Spinning Slot Machine With Superimposed Video Image," U.S. Patent Application Publication Nos. US2010/0069160, titled "Handheld Wagering Game Machine And Docking Unit," and US2010/0234099, titled "Wagering Game System With Docking Stations" which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
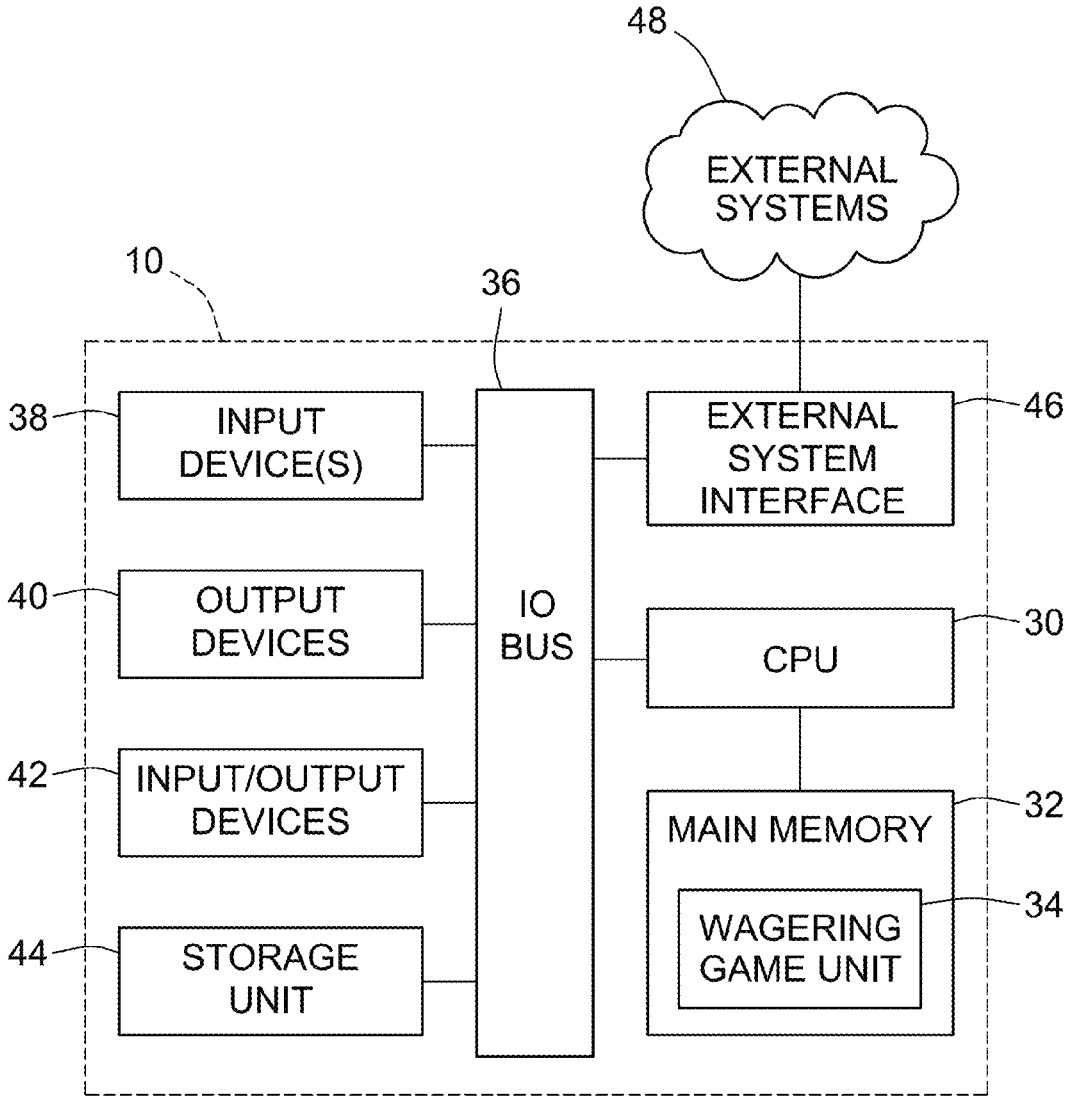
FIG. 2 (PRIOR ART)
FIG. 2 is a schematic view of a gaming system according to an embodiment of the present invention.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
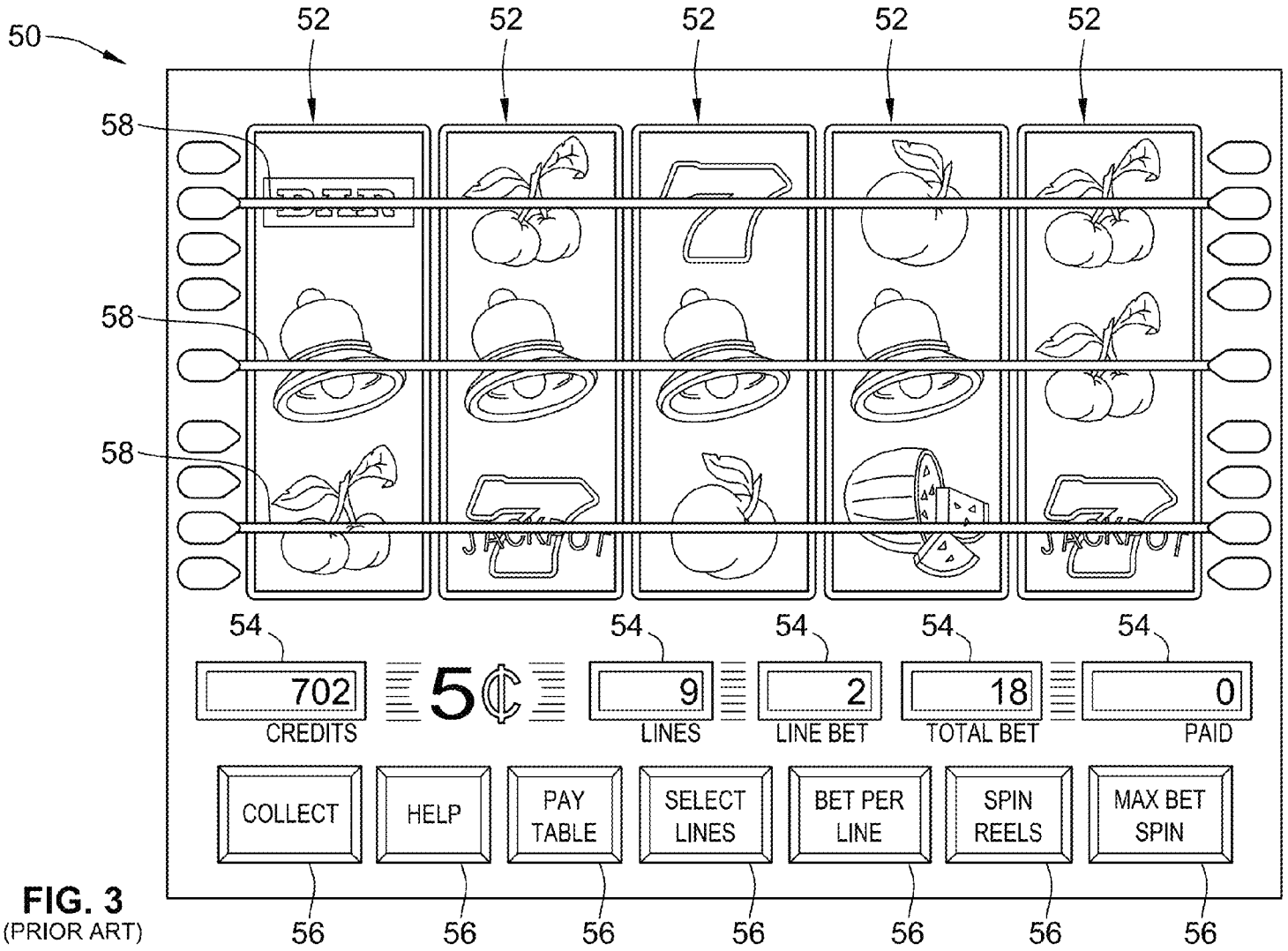
FIG. 3 (PRIOR ART)
FIG. 3 is an image of an exemplary basic-game screen of a wagering game displayed on a gaming terminal, according to an embodiment of the present invention.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving an input indicative of a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Referring now to FIGS. 4-12, aspects of a wagering game employing a threshold-based enhancement functionality will be described. In a wagering game employing a threshold-based enhancement functionality, one or more game enhancements are provided when an aggregate amount of awards exceeds a threshold amount. Different types of game enhancements provide the player with an opportunity to achieve a higher payout (or other award) or make it easier for the player to achieve a payout (or other award). As such, the game enhancements provide a player with additional excitement during play.

A game enhancement as used herein can include one or more parameters that affect or modify how a wagering game is conducted. For the sake of clarity, a game enhancement as used herein does not include the outright award of a jackpot (i.e., the award of a jackpot solely based on the aggregate amount of award(s) exceeding the threshold amount). As non-limiting examples, a game enhancement can include one or more multipliers, wilds, automatic nudges, pay table upgrades, scatter conversions, individual reel re-spins, free spins, morphs, automatic wager increases, hold symbols, symbol movements, combinations thereof, and/or the like.

A multiplier game enhancement can be provided to multiply a payout or other outcome awarded to the player. The value of the multiplier (e.g., 2× multiplier or 3× multiplier) can be a randomly determined or a fixed value. The value of the multiplier can be predetermined (i.e., determined prior to a play of the wagering game) or dynamically determined (i.e., during and/or after a play of the wagering game).

An automatic nudge game enhancement is advantageous in situations where a better payout can be achieved by moving symbols on one (or multiple) reels either up or down across a payline.

A different-pay-table game enhancement implements a different and higher-paying pay table, awarding larger payouts for various symbol combinations. For example if a combination of three "cherry" symbols normally pays out 200% of the original wager, the different-pay-table game enhancement may result in a payout of 300% of the original wager for the same combination. Similarly, if a combination of three "7" symbols normally pays out 500% of the original wager, the different-pay-table game enhancement may result in a payout of 1000% of the original wager for the same combination.

An upgrade game enhancement causes a winning symbol combination to move up at least one winning symbol combination on the pay table for the gaming terminal 10. For example, a lower-paying combination of three "cherry" symbols may pay out as if the player had achieved three "3-bars" symbols, a better combination.

An extra-wild game enhancement causes a symbol that is normally a regular symbol, such as a "cherry" symbol or a "1-bar" symbol, to become a wild symbol.

The scatter game enhancement converts a line pay payout into a scatter payout, such that a winning combination of symbols need not be located all on a single active payline.

The right-to-left enhancement allows "right-to-left" combinations (i.e., combinations starting on the right-most reel and extending left across the reels) to win, in addition to the standard winning "left-to-right" combinations.

The re-spin enhancement re-spins one or more of the reels if the player does not achieve any winning combination and/or a winning combination associated with an award above a predetermined amount, giving the player an additional chance to get a winning combination and/or a better winning combination.

The morph game enhancement allows one or more symbols on the reels to morph into other symbols that are more beneficial.

The hold symbol game enhancement holds one or more symbols in a certain location on the reels so that, after respinning, a final symbol combination across the reels takes into account the held symbol.

The symbol movement game enhancement allows one or more symbols to move to other locations along a payline if it would result in a better outcome (e.g., a higher award).

A winning combination typically results in a payout that is generally proportionate to the amount wagered. For example, when five credits are wagered and the player achieves a winning combination, the payout is at least five times as large as it would have been if only one credit had been wagered. The increased-wager game enhancement treats a winning combination as though the player had bet the maximum amount, thereby effectively increasing the wagered amount, resulting in a higher payout. For example, of the player had only wagered one of five possible credits, the increased-wager game enhancement would treat the player's wager as though five credits had been wagered.

It should be understood that the game enhancements described above are provided as examples of potential game enhancements. It is contemplated that other game enhancements can be employed in connection with the threshold-based game-enhancement functionalities described herein.

Figure 4:
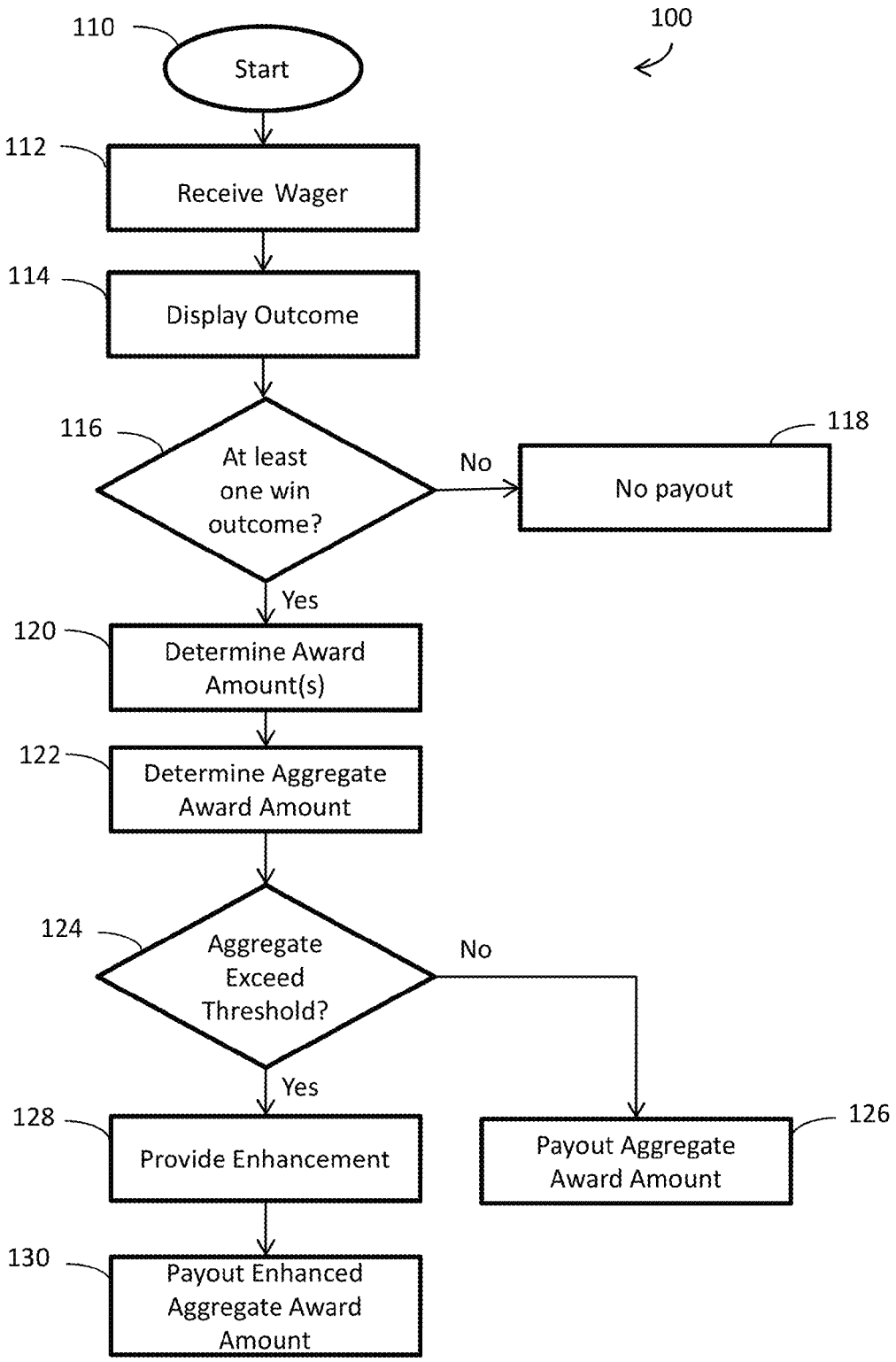
FIG. 4 is a flowchart for an algorithm that corresponds to instructions executed by a controller in accord with at least some aspects of the disclosed concepts.

According to some aspects of the present concepts, a threshold-based enhancement functionality can be provided for a single play of a wagering game. FIG. 4 is a flowchart of an exemplary algorithm 100 for conducting a single play of a wagering game employing a threshold-based enhancement functionality according to some aspects of the present concepts. At block 110, the algorithm 100 is initiated. At block 112, an input indicative of a wager is received via one or more of the input devices (e.g., the touch screen 18, the buttons 20, etc.). At block 114, a randomly selected outcome for the wagering game is displayed via one or more of the output devices (e.g., the primary display area 12, the secondary display area 14, etc.). At block 116, the randomly selected outcome is evaluated (e.g., via the CPU 30) to determine whether the randomly selected outcome includes at least one winning outcome. If it is determined, at block 116, that the randomly selected outcome does not include at least one winning outcome, then no payout is awarded to the player and the algorithm 100 terminates at block 118.

If it is determined at block 116 that the randomly selected outcome includes at least one winning outcome, then an award amount is respectively determined for each winning outcome of the randomly selected outcome at block 120. For example, as described above with respect to FIG. 3, the award amount(s) can be determined based on a player's received wager in accordance with a pay table (e.g., a line pay combination on an activated payline and/or a scatter pay).

At block 122, the award amount(s) determined at block 120 are aggregated to determine an aggregate award amount. At block 124, it is determined whether the aggregate award amount is greater than a threshold amount. According to aspects of the present disclosure, the threshold amount can be determined in a number ways. For example, according to some aspects, the threshold amount can be a randomly determined value, a value based on a player's input(s) prior to the play of the wagering game (e.g., a value based on a multiple of the player's wager), and/or a fixed value not based on a player input (e.g., a value based on the max wager regardless of the player's actual wager). As another example, according to some aspects, the threshold amount can be a predetermined amount in that the threshold amount is determined prior to the play of the wagering game or a dynamically determined amount in that the threshold amount is determined prior to, during, and/or after initiating the play of the wagering game.

If it is determined at block 124 that the aggregate amount is not greater than the threshold amount, the aggregate award amount is awarded (e.g., credited, paid out, etc.) to the player at block 126. If it is determined at block 124 that the aggregate amount is greater than the threshold amount, a game enhancement is provided at block 128. The game enhancement can be provided by modifying or enhancing the randomly selected outcome and/or the aggregate award amount, according to the provided/selected game enhancement, to determine an enhanced award amount. At block 130, the enhanced award amount is awarded to the player.

Figure 5:
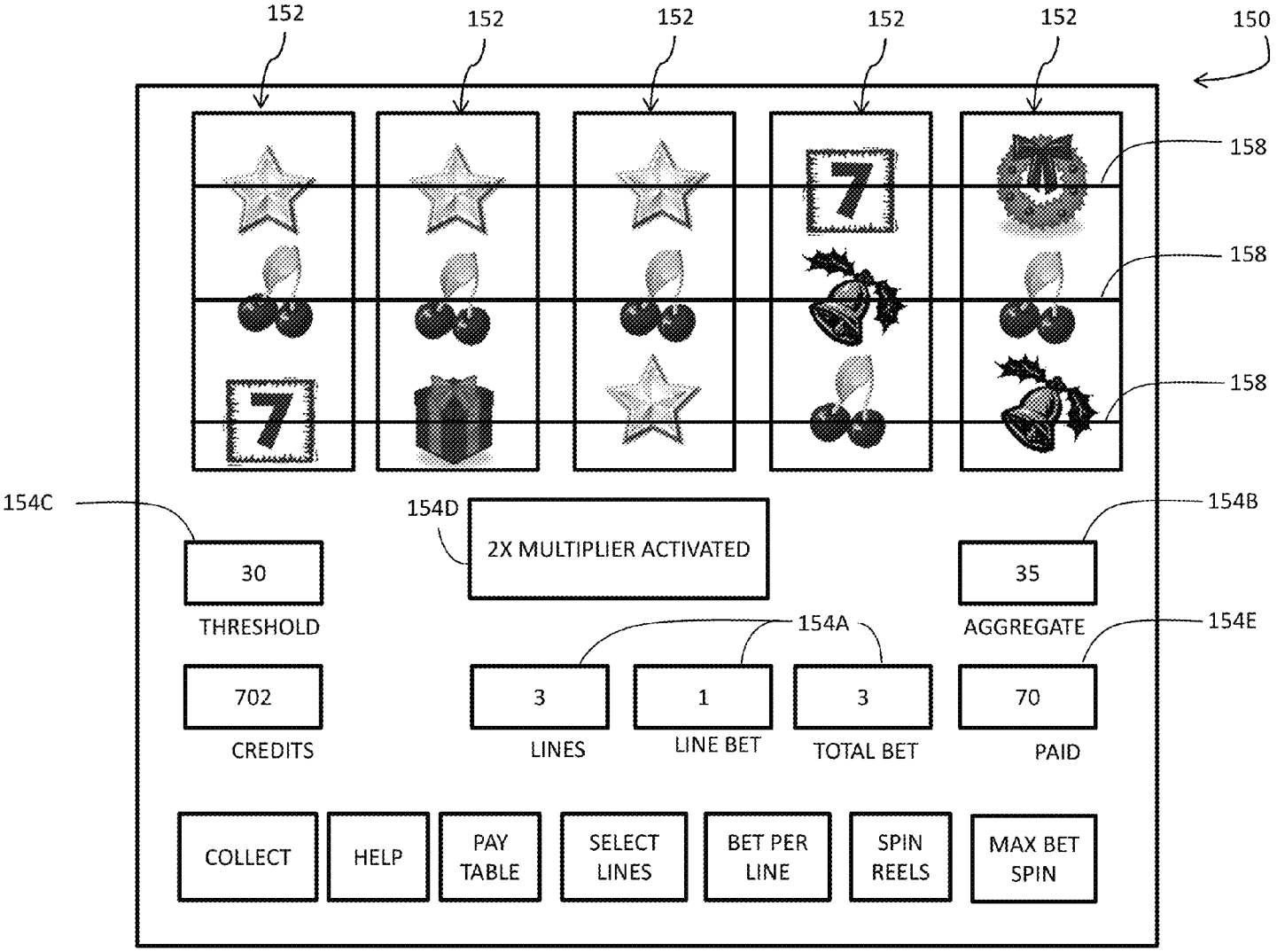
FIG. 5 is an image of an exemplary wagering game screen displayed on a gaming terminal, according to an embodiment of the present invention.

FIG. 5 illustrates a non-limiting example of a wagering game screen 150 displaying a randomly selected outcome for a wagering game employing a threshold-based enhancement functionality. In this example, the displayed credit meters 154A indicate that the player wagered one credit on three paylines 158 prior to the play of the wagering game. The illustrated randomly selected outcome includes a first winning combination of symbols (e.g., three "star" symbols on an active payline) that pays 10 credits, a second winning combination of symbols (i.e., four "cherry" symbols on an active payline) that pays 20 credits, and a third winning combination of symbols (i.e., two "bell" scatter symbols) that pays 5 credits based on the player's wager and the pay table (not shown). As shown by a meter 154B, an aggregate award amount of 35 credits, which was determined by summing the award amounts for the first, second, and third winning combinations. A meter 154C indicates that the threshold amount is 30 credits for this example. Because the aggregate amount exceeded the threshold amount, a game enhancement, such as a multiplier having a value of 2×, may be provided as indicated by the announcement 154D. As a result, the player was awarded an enhanced award amount of 70 credits as indicated by a meter 154E.

Figure 6:
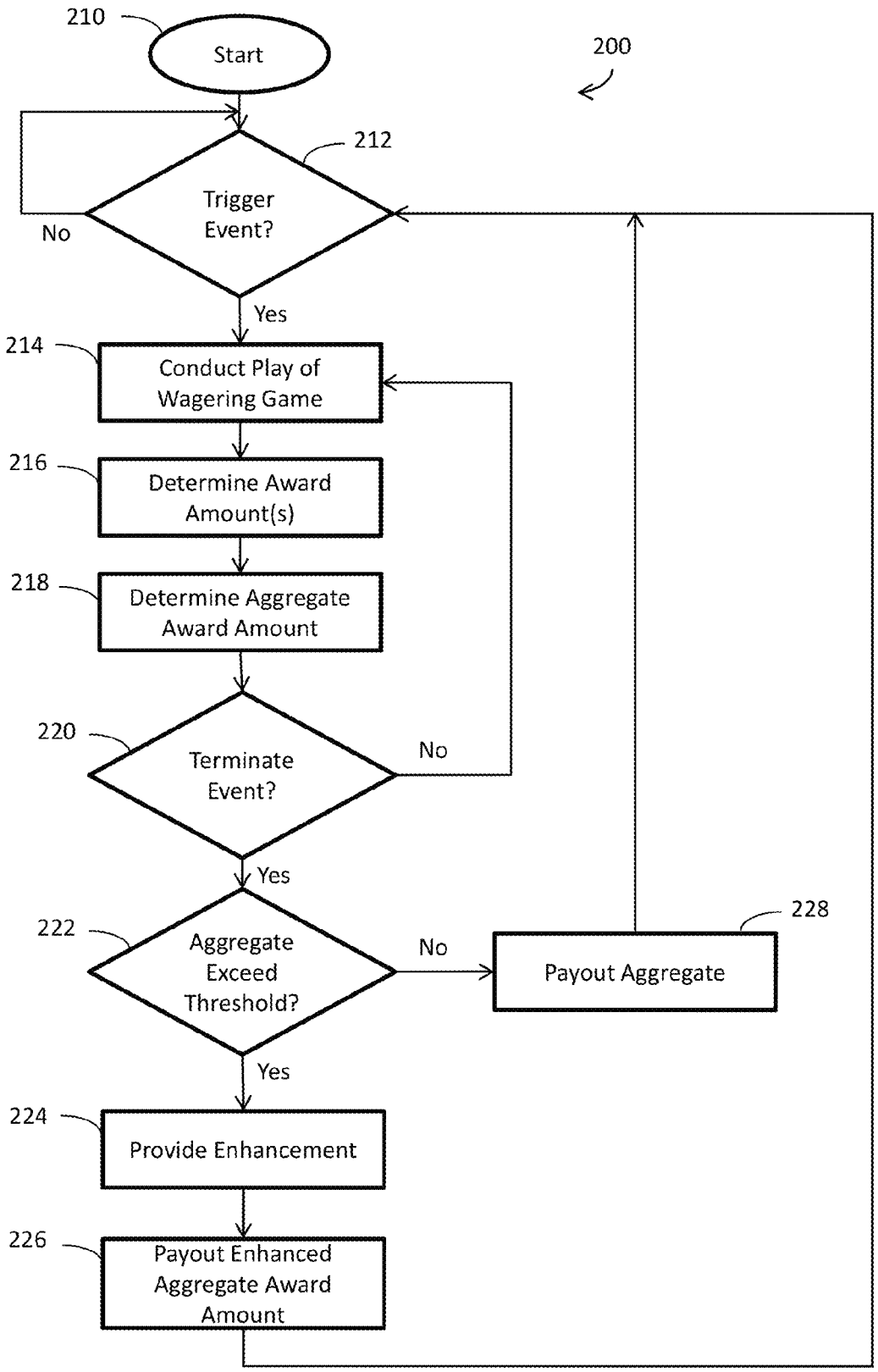
FIG. 6 is a flowchart for an algorithm that corresponds to instructions executed by a controller in accord with at least some aspects of the disclosed concepts.

According to some aspects of the present concepts, a threshold-based enhancement functionality can be provided over one or more plays of a wagering game. FIG. 6 is a flowchart of an exemplary algorithm 200 for conducting one or more plays of a wagering game employing a threshold-based enhancement functionality according to some aspects of the present concepts. At block 210, the algorithm 200 is initiated. At block 212, it is determined whether a triggering event has occurred. The triggering event can be any event that triggers the threshold-based enhancement functionality for the wagering game as will be described in greater detail below. If it is determined that the triggering event has occurred at block 212, then a play of a wagering game is conducted (e.g., via the CPU 30 and at least one of the displays 12, 14) at block 214. At block 216, the award amount(s) (if any) are determined based on the conducted play of the wagering game at block 214. At block 218, all of the award amount(s) that have been determined (at block 216) since it was determined that the triggering event occurred (at block 212) are aggregated to determine an aggregate award amount. At block 220, it is determined whether a terminating event has occurred. The terminating event can be any event that terminates the threshold-based enhancement functionality after the play of the wagering game as will be described in detail below. If it is determined that the terminating event has not occurred at block 220, then the algorithm returns to block 214 to conduct an additional play of the wagering game.

The algorithm 200 continues to cycle through blocks 214, 216, 218, and 220 until it is determined at block 220 that the terminating event has occurred. If it is determined that the terminating event has occurred at block 220, the algorithm 200 proceeds to block 222. At block 222, it is determined whether the aggregate amount determined at the last instance of block 218 (i.e., the summation of all award amount(s) determined at block 216 since it was determined that the triggering event occurred at block 212) is greater than a threshold amount. The threshold amount can be determined as described above with respect to FIG. 4. If it is determined that the aggregate amount is greater than the threshold amount at block 222, then a game enhancement is provided to the player to determine an enhanced award amount. For example, in one implementation, the aggregate amount can be modified by a multiplier game enhancement to determine the enhanced award amount. At block 226, the enhanced award amount is awarded to the player. The algorithm 200 then returns from block 226 to block 212.

If, on the other hand, it is determined at block 222 that the aggregate amount is not greater than the threshold amount, then the aggregate award amount is awarded to the player at block 228 and the algorithm returns to block 212.

As described above, the triggering event can be any event that triggers or initiates the threshold-based enhancement functionality. Because the threshold-based enhancement functionality may not be utilized until the triggering event occurs (at least according to some aspects), the triggering event can be configured to include eligibility criteria for a player to play a wagering game with a threshold-based enhancement functionality and/or receive a game enhancement.

According to some aspects of the present concepts, the triggering event can include one or more gameplay-related events. For example, the triggering event can include the occurrence of a special symbol appearing in a randomly selected outcome of a wagering game. That is, the threshold-based enhancement functionality may be initiated for one or more plays of the wagering game after the player achieved a randomly selected outcome including the special symbol. As another example, the triggering event can include the occurrence of a predetermined combination of symbols appearing in a randomly selected outcome of a wagering game.

According to additional or alternative aspects, the triggering event can include an event based on one or more player inputs (e.g., received by the CPU 30). For example, the threshold-based enhancement functionality can be initiated in response to a max-bet wager by a player. As another example, the threshold-based enhancement functionality can be initiated in response to an input indicating payment of an additional fee by the player (e.g., a side bet). As a further example, the threshold-based enhancement functionality can be triggered in response to a player input indicative of a player's desire to initiate the threshold-based enhancement functionality received via one or more of the buttons on the button panel 20 and/or the touch screen 18.

According to additional or alternative aspects, the triggering event can include a time-based and/or a play-count-based event. For example, the threshold-based enhancement functionality can be triggered after a predetermined amount of time has passed since play was first initiated by a particular player on a gaming terminal or since the last occurrence of the triggering event. As another example, the threshold-based enhancement functionality can be triggered after a randomly determined amount of time has passed since play was initiated by a player on a gaming terminal or since the last occurrence of the triggering event. As yet another example, the threshold-based enhancement functionality can be triggered after a predetermined number or a randomly determined number of play(s) have been conducted since play was initiated on the gaming terminal 10 or since the last occurrence of the triggering event. It is contemplated that, according to some aspects, the gaming terminal 10 can include a player tracking or player identification system (not shown) to ensure that the triggering event is based on the play of a particular player and prevent a situation where other players wait for a player to leave a gaming terminal 10 in the hope of triggering the threshold-based game enhancement sooner.

According to additional or alternative aspects, the triggering event can include a turnover-based event. For example, the threshold-based enhancement functionality can be triggered after a predetermined amount or a randomly determined amount of coin-in or turnover has been achieved over a period of time and/or a number of plays. In an exemplary implementation, the turnover amount can be greater than at least a predetermined bet amount over a preset period of time or a number of plays of the wagering game. In one non-limiting example of this exemplary implementation, the predetermined bet amount can be the maximum bet amount. In this way, the triggering event can be a turnover amount over a plurality of plays of the wagering game. It is contemplated that, according to some aspects, the gaming terminal 10 can include a player tracking or player identification system (not shown) to ensure that the triggering event is based on the turnover amount of a particular player and prevent a situation where other players wait for the player to leave a gaming terminal 10 in the hope of triggering the threshold-based game enhancement sooner.

It should be understood that, according to aspects of the present concepts, the triggering event can include any one or a combination of the above-described exemplary events and/or the like. According to some aspects, if a plurality of the events comprises the triggering event, some or all of the events may not be required to occur contemporaneously. In other words, if the triggering event includes a plurality of events, some or all of the plurality of events need not occur at substantially the same time. For example, in one exemplary implementation, the triggering event can include the occurrence of a predetermined symbol combination in a randomly selected outcome and the receipt of a player input. In this exemplary implementation, the occurrence of the predetermined symbol combination may make the threshold-based enhancement functionality available to the player, but the player may opt to wait to initiate the threshold-based enhancement functionality until a later time. The triggering event triggering the threshold-based enhancement functionality would not occur until the player actuated the player input associated with the threshold-based enhancement functionality.

According to some aspects, if a plurality of events comprises the triggering event, some or all of the events event may be required to occur contemporaneously. In other words, if the triggering event includes a plurality of conditions, some or all of the plurality of conditions may need to occur at substantially the same time. For example, in an exemplary implementation, the triggering event can be the occurrence of a predetermined symbol combination in a randomly selected outcome for a play of a wagering game in which a player made a max wager. In this exemplary implementation, if the predetermined symbol combination occurred but the player did not wager the max amount, the threshold-based enhancement functionality would not be initiated.

According to some aspects of the present concepts, the triggering event(s) can be configured to determine the game enhancement(s) that are achievable from the one or more plays of the wagering game after the triggering event. In other words, different triggering events can cause different game enhancements to be achievable. For example, the triggering event can include a plurality of triggering events that are each associated with one or more of a plurality of game enhancements. In one non-limiting implementation, a threshold-based enhancement functionality in which a first set of one or more potential enhancements are achievable is triggered in response to a max bet wager and a different threshold-based enhancement functionality in which a different set of one or more potential enhancements are achievable is triggered in response to a wager that is less than the max wager amount. It is contemplated that, according to a further non-limiting implementation, the triggering event(s) and the associated game enhancement(s) can be configured such that the amount of a potential payout and/or the likelihood of achieving a payout increases as the amount of a wager requirement for a triggering event increases.

FIG. 7 illustrates an exemplary table indicating an association between a plurality of triggering events and a plurality of game enhancements. In the illustrated example, an occurrence of a symbol combination including three "cherry" symbols triggers one or more plays in which a "2×" multiplier game enhancement is achievable, an occurrence of a symbol combination including four "cherry" symbols triggers one or more plays in which a "3×" multiplier game enhancement is achievable, an occurrence of a max wager and a symbol combination including three "cherry" symbols triggers one or more plays in which a "3×" multiplier game enhancement is achievable, and an occurrence of a max wager and a symbol combination including four "cherry" symbols triggers one or more plays in which a "4×" multiplier game enhancement is achievable. This example demonstrates that the triggering event can be configured to provide more or less advantageous opportunities to win an enhanced aggregate award amount from the threshold-based game functionality based on an expected likelihood that the triggering event will occur.

FIG. 8 illustrates another exemplary table indicating an association between a plurality of triggering events and a plurality of game enhancements. In the illustrated example, each of the triggering events is associated with more than one game enhancement. The exemplary table further indicates the probability that a game enhancement will be achievable if the associated triggering event occurred. According to the exemplary table, upon the occurrence of a symbol combination including three "cherry" symbols, there is a 60% chance that the game enhancement will be a "2×" multiplier, a 30% chance that the game enhancement will be a "3×" multiplier, and a 10% chance that the game enhancement will be a "4×" multiplier. Upon the occurrence of a max wager and a symbol combination including three "cherry" symbols, there is a 40% chance that the game enhancement will be a "2×" multiplier, a 40% chance that the game enhancement will be a "3×" multiplier, and a 20% chance that the game enhancement will be a "4×" multiplier. Upon the occurrence of a symbol combination including four "cherry" symbols, there is a 33.33% chance that the game enhancement will be a "2×" multiplier, a 33.33% chance that the game enhancement will be a "3×" multiplier, and a 33.33% chance that the game enhancement will be a "4×" multiplier. Upon the occurrence of a max wager and a symbol combination including four "cherry" symbols, there is a 20% chance that the game enhancement will be a "2×" multiplier, a 30% chance that the game enhancement will be a "3×" multiplier, and a 50% chance that the game enhancement will be a "4×" multiplier.

It is contemplated that, according to additional or alternative aspects of the present concepts, a triggering event can be associated with a plurality of potential game enhancements and the player can be prompted (e.g., via one or more of the display devices 12, 14) to select one of the game enhancements from the plurality of potential game enhancements (e.g., via the buttons 20 and/or the touch screen 18) in response to a determination that the triggering event has occurred at block 212.

It is also contemplated that, according to additional or alternative aspects of the present concepts, a triggering event can be associated with a plurality of potential game enhancements and one or more of the plurality of potential game enhancements can be determined by the outcome(s) of the one or more plays of the wagering game conducted after the triggering event. In one non-limiting example, the threshold amount can include a plurality of threshold amounts and each of the plurality of threshold amounts can be associated with a respective game enhancement. In this example, after it is determined that the terminating event occurs at block 220, the aggregate amount is evaluated with respect to the threshold amounts at block 222 to determine whether the aggregate amount is greater than the threshold amounts. The game enhancement associated with the threshold amount having the greatest value (relative to the other threshold amounts) and determined to be less than the aggregate amount at block 222 is provided at block 224 as previously described.

In one exemplary implementation, a triggering event can be associated with a "2×" multiplier game enhancement, a "3× multiplier game enhancement, and a "4×" multiplier game enhancement. The threshold amount can include a first threshold level of 100 credits associated with the "2×" multiplier, a second threshold level of 150 credits associated with the "3×" multiplier, and a third threshold level of 200 credits associated with the "4×" multiplier. If the aggregate amount is greater than 100 credits and less than 150 credits after the terminating event is determined, the "2×" multiplier is provided at block 224. If the aggregate amount is greater than 150 credits and less than 200 credits after the terminating event is determined, the "3×" multiplier is provided at block 224. If the aggregate amount is greater than 200 credits after the terminating event is determined, the "4×" multiplier is provided at block 224.

It is contemplated that, according to some aspects of the present concepts, an indication of the player's progress towards the next threshold level can be provided (e.g., via one or more of the output devices) to the player as the one or more plays of the wagering game are conducted after the triggering event. Accordingly, it is contemplated that the steps of the algorithm 200 can be modified, for example, so that the determination of whether the aggregate amount exceeds the threshold amount(s) at block 222 can be performed prior to the determination that the terminating event has occurred at block 220. Additional details with respect to indicators of a player's progress towards the threshold amount(s) are described below with respect to FIGS. 11A-12.

As another non-limiting example, according to additional or alternative aspects, one or more symbols and/or symbol combinations that occur during the one or more plays after the triggering event can determine which of the plurality of potential game enhancements are provided at block 224. As an exemplary implementation, the number of occurrences of a special symbol during the one or more plays of the wagering game (i.e., after the triggering event at block 212 and prior to the terminating event at block 220) determines which of a plurality of potential game enhancements are provided to the player if the aggregate amount is greater than the threshold amount. For example, the game enhancement can be a "2×" multiplier if no special symbols occur, a "3×" multiplier if one special symbol occurs, a "4×" multiplier if two special symbols occur, and a "5×" multiplier if three special symbols occur during the one or more plays of the wagering game. The game enhancement determined by the outcomes of the one or more plays would then be awarded if the aggregate amount was greater than the threshold amount.

As described above, the threshold-based enhancement functionality can be employed until it is determined that the terminating event has occurred at block 220. As such, the terminating event can be any event that terminates or indicates the end of the threshold-based enhancement functionality.

According to some aspects, the terminating event can occur upon the expiration of an amount of time since the threshold-based enhancement functionality was initiated (e.g., since it was determined that the triggering event occurred at block 212). The amount of time can be a predetermined amount of time (e.g., an amount of time determined prior to the occurrence of the triggering event) and/or a dynamically determined amount of time (e.g., an amount of time determined after the triggering event). The amount of time can be a fixed amount and/or a randomly determined amount of time. In one non-limiting example, a timer can be displayed to the player (e.g., via one or more of the displays 12, 14) that indicates the time remaining until the threshold-based enhancement functionality will terminate. The terminating event can occur when the timer expires, ending the threshold-based enhancement functionality.

According to additional or alternative aspects, the terminating event can occur when a number of plays of the wagering game are conducted after the threshold-based enhancement functionality was initiated. The number of plays can be a predetermined amount of plays (e.g., an amount of plays determined prior to the occurrence of the triggering event) and/or a dynamically determined amount of plays of the wagering game (e.g., an amount of plays determined after the triggering event). The number of plays can be a fixed number of plays and/or a randomly determined number of plays. In a non-limiting example, when the triggering event occurs a free spins game may be triggered, providing the player with a number of free spins utilizing the threshold-based enhancement functionality. In this example, a counter can be displayed to the player (e.g., via one or more of the displays 12, 14) that indicates the number of plays remaining until the free spins game employing the threshold-based enhancement functionality will terminate. After each spin in the free spins game, the counter is decremented until the terminating event occurs when the counter reaches zero, ending the threshold-based enhancement functionality.

According to additional or alternative aspects, the terminating event can include the occurrence of one or more game-terminating symbols in a randomly selected outcome. After the triggering event occurs, the one or more plays of the wagering game employing the threshold-based enhancement functionality can be conducted until the game-terminating symbol appears in a randomly selected outcome. Upon the occurrence of a game-terminating symbol or a game-terminating combination of symbols, the threshold-based enhancement functionality ends. It is contemplated that, according to some aspects, the likelihood of a randomly selected outcome including the one or more game-terminating symbols can increase with each successive play of the wagering game.

According to additional or alternative aspects, the terminating event can be configured such that the threshold-based enhancement functionality will terminate after a single play of the wagering game. For example, the terminating event can occur when the award(s) are aggregated at block 218 (i.e., after one play of the wagering game). Indeed, it is contemplated that according to some aspects of the present concepts, the triggering event and the terminating event can be configured such that the threshold-based enhancement functionality can be initiated before and terminated after every play of the wagering game.

It should be understood that, according to aspects of the present concepts, the terminating event can include any one or a combination of the above described exemplary events and/or the like. As one non-limiting example, the terminating event can occur upon an amount of time expiring or a game-terminating symbol appearing in a randomly selected outcome, whichever occurs earlier.

According to some aspects of the present concepts, the terminating event can be randomly determined from a plurality of potential terminating events prior to conducting the one or more plays of the wagering game after the triggering event. According to additional or alternative aspects of the present concepts, the terminating event can be determined from a plurality of potential terminating events based on the triggering event determined at block 212. For example, a wagering game can include a plurality of triggering events that are each associated with one or more of a plurality of terminating events. The occurrence of a particular one of the triggering events can initiate a threshold-based enhancement functionality that terminates upon the occurrence of the one or more terminating events associated with that triggering event.

FIG. 9 illustrates an exemplary table indicating the association between a plurality of triggering events and a plurality of terminating events. In the illustrated example, an occurrence of a symbol combination including three "cherry" symbols triggers a threshold-based enhancement functionality that terminates after five spins, an occurrence of a symbol combination including four "cherry" symbols triggers a threshold-based enhancement functionality that terminates after ten spins, an occurrence of a max wager and a symbol combination including three "cherry" symbols triggers a threshold-based enhancement functionality that terminates after fifteen spins, and an occurrence of a max wager and a symbol combination including four "cherry" symbols triggers a threshold-based enhancement functionality that terminates after three minutes. This example demonstrates that the triggering event and the terminating event can be configured to provide more or less advantageous opportunities to win an award or achieve a game enhancement from the threshold-based game functionality based on an expected likelihood that the triggering event and/or the terminating event will occur.

According to some aspects of the present disclosure, the terminating event can be fixed such that the one or more plays of the wagering game conducted after the triggering event (e.g., at block 212) do not affect the terminating event. According to additional or alternative aspects, the terminating event can change based on the one or more plays of the wagering game after the triggering event (and prior to the terminating event). For example, after the threshold-based enhancement functionality is initiated (i.e., after the triggering event is determined to have occurred at block 212), the terminating event can have an initial value, which increases and/or decreases based on the outcomes of the wagering game prior to the occurrence of the terminating event. As an exemplary illustration, a terminating event that is initially set to occur after five plays of the wagering game may be increased to ten plays if the player achieves certain outcome(s) (e.g., an appearance of a "more-spins" symbol) during the initial five plays of the wagering game. As another exemplary illustration, a terminating event that is initially set to occur after five plays of the wagering game may be increased to ten plays if the aggregate amount is determined to exceed a first threshold level during the initial five plays of the wagering game and increased to twenty plays if the aggregate amount is determined to exceed a second threshold level during the ten plays of the wagering game.

It is contemplated that, according to some aspects, the threshold-based functionality can be employed in a basic wagering game, a bonus wagering game, and/or combinations thereof. In a basic game, for example, each time a play of the wagering game is conducted at block 214, an input indicative of a wager can be received. In other words, according to some aspects, the conducting of the wagering game at block 214 can include receiving a wager prior to the play of the wagering game when the threshold-based enhancement functionality is employed in a basic wagering game. In a bonus game, for example, a wager may or may not be received for each play of the wagering game. In one non-limiting implementation, the bonus game can be a free spins event in which no wager is received for each spin of the wagering game.

In the exemplary embodiment illustrated and described with respect to FIG. 6, the game enhancement was provided after the terminating event occurred (i.e., at the end of the threshold-based game enhancement feature). FIG. 6, described by way of example above, represents an exemplary algorithm that corresponds to at least some instructions executed by the CPU 30 in FIG. 2 to perform the above described functions associated with the disclosed concepts. It is also within the scope and spirit of the present concepts to omit steps, include additional steps, and/or modify the order of steps presented above. For example, it is contemplated that, according to additional or alternative aspects of the present concepts, the game enhancement can be provided prior to the determination that the terminating event has occurred.

Figure 10:
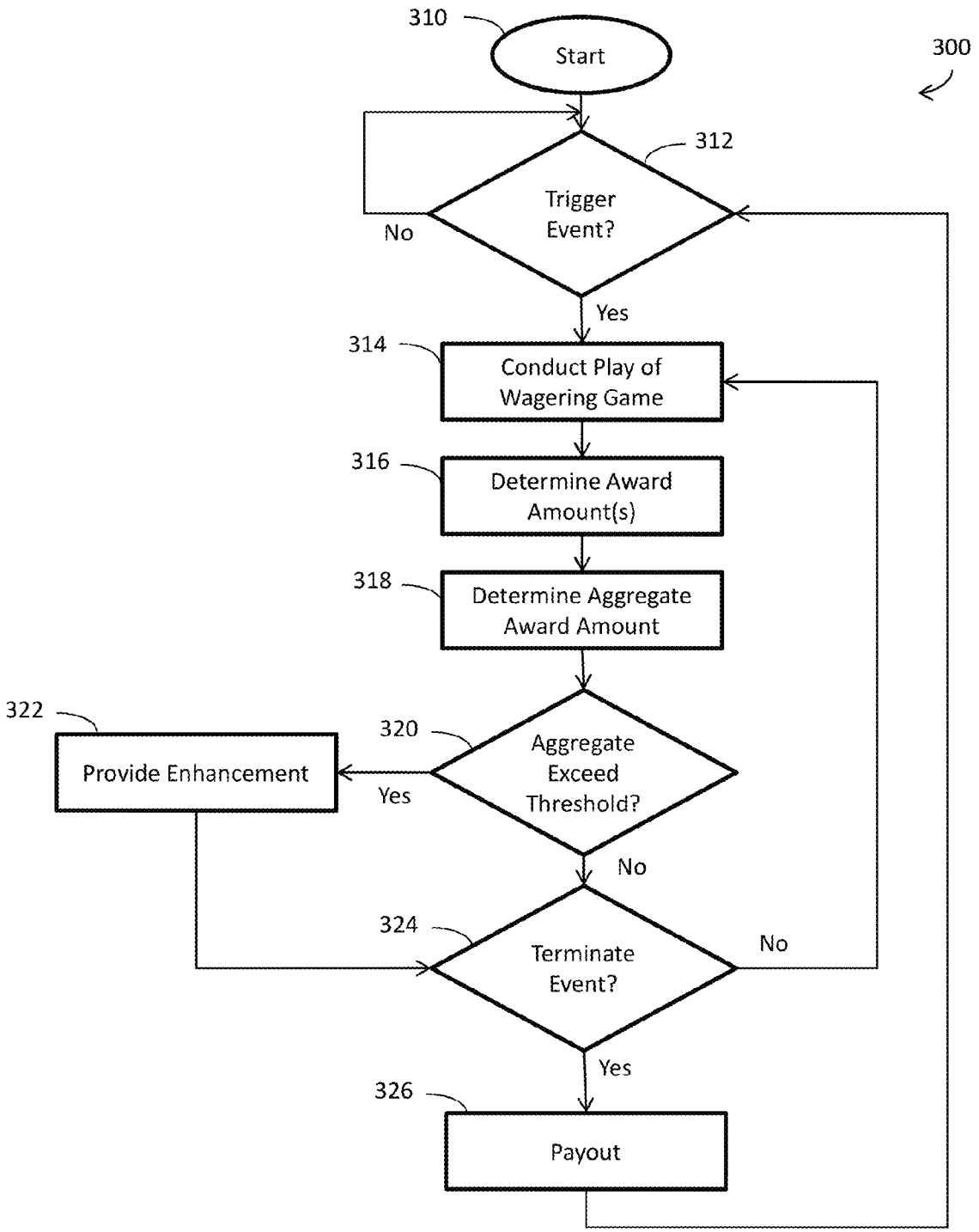
FIG. 10 is a flowchart for an algorithm that corresponds to instructions executed by a controller in accord with at least some aspects of the disclosed concepts.

FIG. 10 is a flowchart of an exemplary algorithm 300 for conducting a wagering game in which a game enhancement can be provided prior to determining that the terminating event has occurred. At block 310, the algorithm 300 is initiated. At block 312, it is determined whether a triggering event has occurred. If it is determined that the triggering event has occurred at block 312, then a play of a wagering game is conducted (e.g., via the CPU 30 and at least one of the displays 12, 14) at block 314. At block 316, the award amount(s) (if any) are determined based on the conducted play of the wagering game at block 314. At block 318, all of the award amount(s) that have been determined (at block 316) since it was determined that the triggering event occurred (at block 312) are aggregated to determine an aggregate award amount. At block 320, it is determined whether the aggregate award amount is greater than a threshold amount.

If it is determined that the aggregate award amount is greater than the threshold amount at block 320, then a game enhancement is provided at block 322. The game enhancement can be provided to affect or modify the randomly determined outcome and/or the determined award(s) of the current play of the wagering game, the randomly determined outcome and/or the determined award(s) of one or more future plays of the wagering game, and/or combinations thereof. For example, a pay table game enhancement can be provided at block 324 to modify or enhance the award amount(s) determined at block 316 and/or the aggregate amount determined at block 318. As another example, the pay table enhancement can be provided at block 324 for one or more additional plays of the wagering game (prior to a determination that the terminating event occurred) subsequently conducted at blocks 314, 316, and 318. It is contemplated that the number of future plays and/or the amount of time for which the game enhancement is provided can be predetermined, dynamically determined, a fixed value, and/or a randomly determined value. It should be understood that any one or more of the other game enhancement(s) described herein (e.g., one or more multipliers, wilds, automatic nudges, pay table upgrades, scatter conversions, individual reel re-spins, free spins, morphs, automatic wager increases, hold symbols, symbol movements, combinations thereof, and/or the like) can be provided at block 324 for the current play and/or one or more future plays of the wagering game.

After the game enhancement is provided at block 322, the algorithm 300 proceeds to block 324 to determine whether the terminating event has occurred. If it is determined that the terminating event has occurred at block 324, then the algorithm 300 proceeds to block 326 to payout the aggregate award amount last determined at block 318 and/or enhanced at block 322. The algorithm 300 returns from block 326 to block 312 to determine whether another triggering event has occurred.

If it is determined that the terminating event has not occurred at block 324, then the algorithm 300 returns to block 314 to conduct an additional play of the wagering game. If it is determined that the aggregate award amount is not greater than the threshold amount at block 320, then at block 322 it is determined whether a terminating event has occurred as described above.

As described above, the gaming terminal 10 can include one or more indicators configured to provide an indication of the aggregate amount relative to the threshold amount. Advantageously, the one or more indicators can inform a player as to their progress towards achieving a game enhancement and/or a level of game enhancement (e.g., where the threshold amount includes a plurality of threshold amounts comprising threshold levels associated with different game enhancements as previously described), thereby increasing player anticipation and excitement.

Figure 11A:
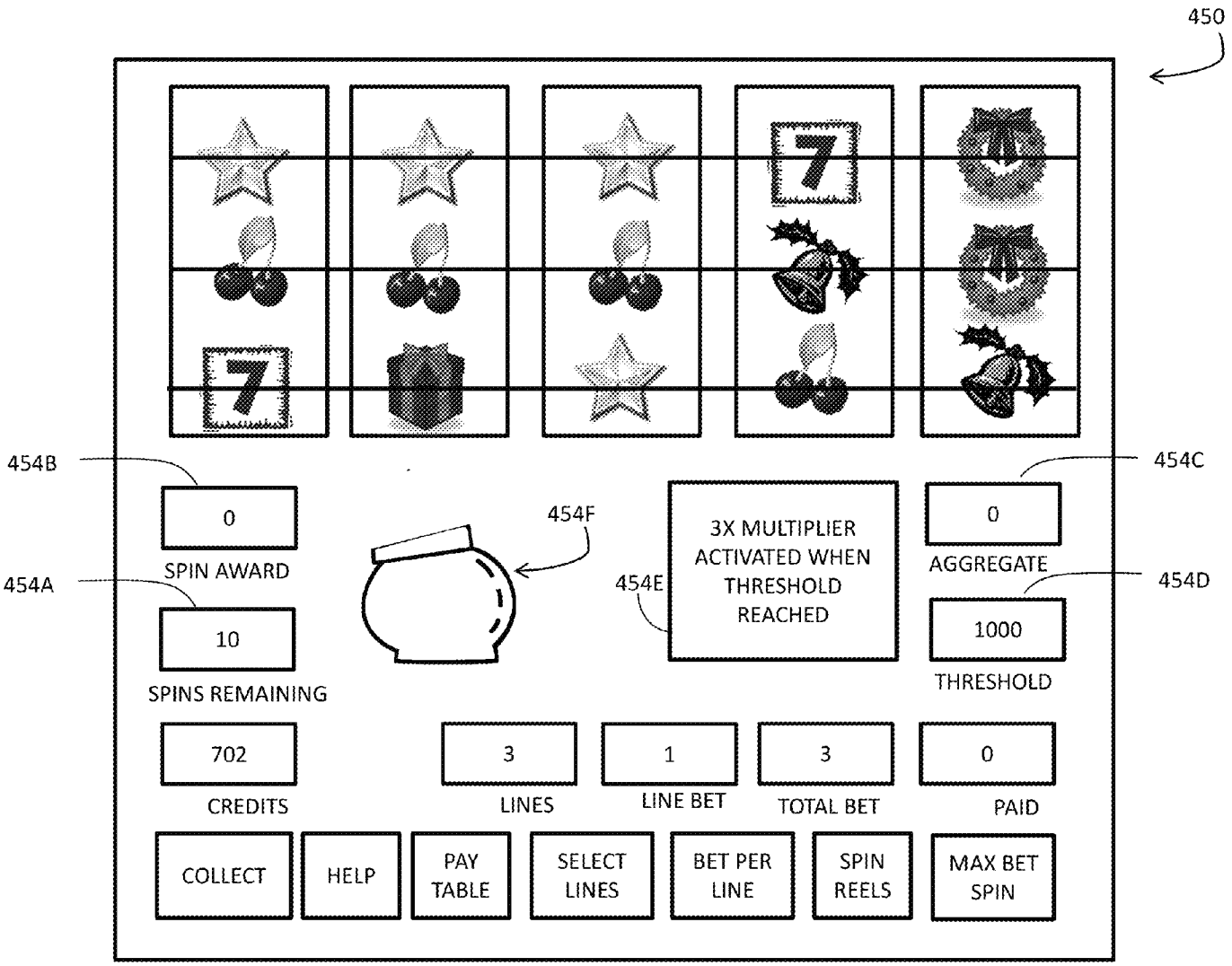
FIGS. 11A-11C is an image of an exemplary wagering game screen displayed on a gaming terminal, according to an embodiment of the present invention.
Figure 11B:
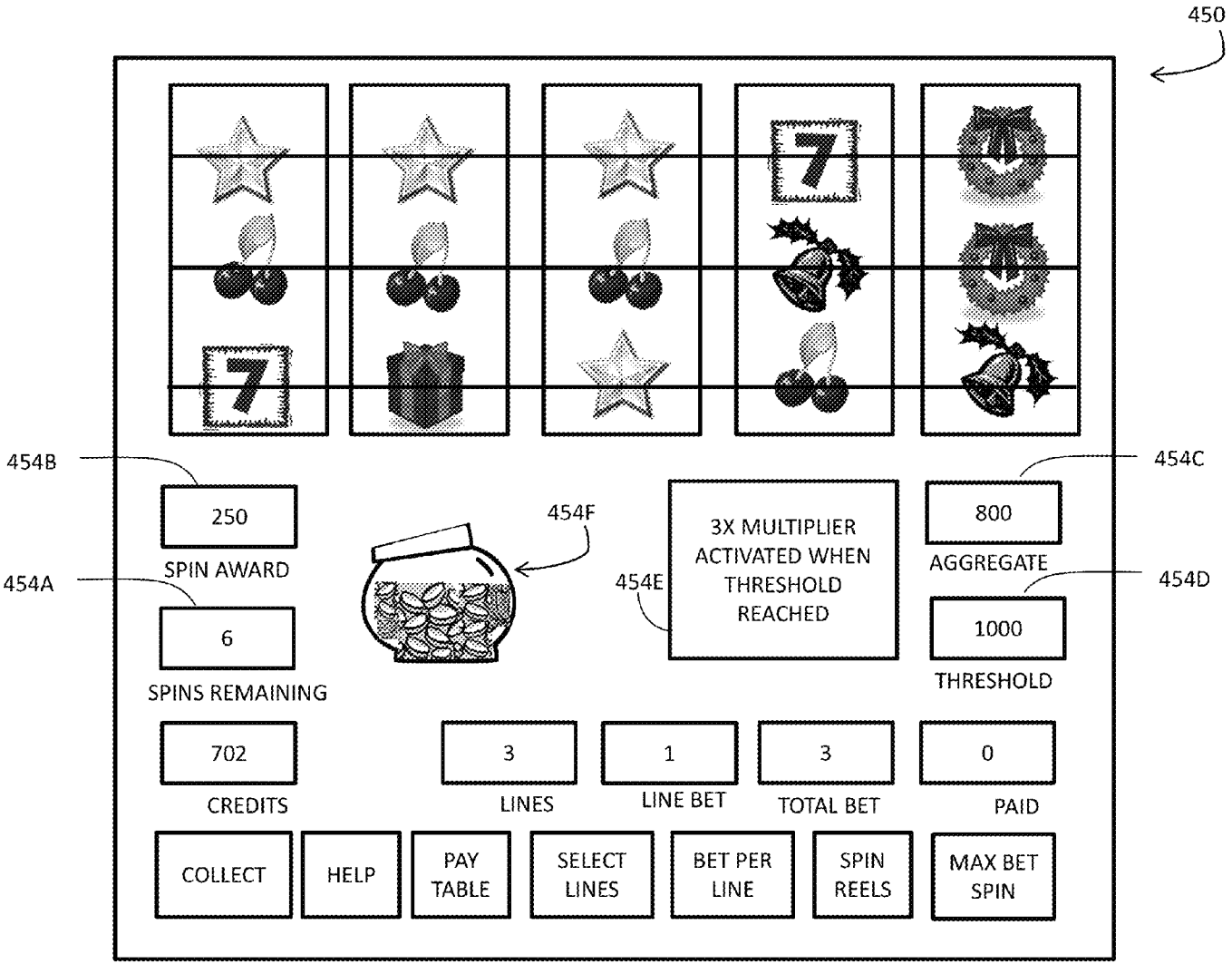
Figure 11C:
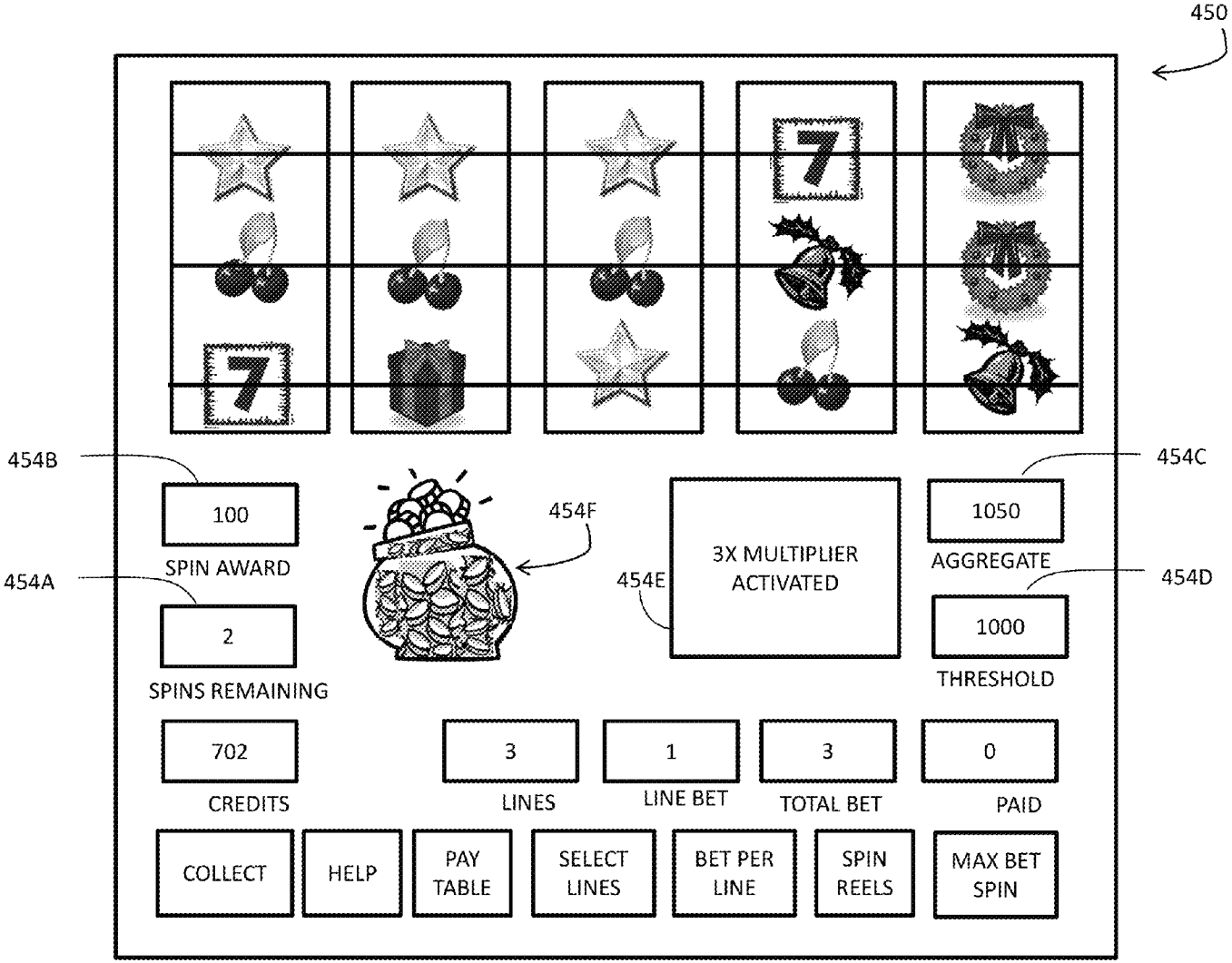

According to some aspects of the present disclosure, the one or more indicators can include numerical indicator(s), textual indicator(s), graphical image indicator(s), combinations thereof, and/or the like. FIGS. 11A-11C illustrate exemplary wagering game screens 450 including one or more indicators according to some aspects of the present concepts. The exemplary wagering game screen 450 shown in FIG. 11A includes a meter 454A that indicates the number of spins remaining until the terminating event occurs, a meter 454B that indicates the award amount(s) determined for a single spin of the wagering game, a meter 454C that indicates the aggregate award amount, a meter 454D that indicates the threshold amount, and an indicator 454E that provides an indication of the game enhancement that can be or has been achieved. In FIG. 11A, no plays of the wagering game have been conducted since it was determined that the triggering event occurred. As such, the meter 454B and the meter 454C indicate that zero credits have been achieved. The meter 454A indicates that the terminating event will occur after ten spins. The meter 454D indicates that the threshold amount is 1000 credits. The indicator 454E indicates that a "3×" multiplier can be achieved if the aggregate amount indicated by the meter 454C exceeds the threshold amount indicated by the meter 454D.

The exemplary wagering game screen 450 further includes an indicator 454F that provides a graphical image indication of the aggregate amount relative to the threshold amount. More particularly, the indicator 454F is a graphical image of a pot. As the wagering game is played, increases in the aggregate amount are graphically depicted by gold coins filling the pot. The volume of the gold coins relative to the volume of the pot is representative of the aggregate amount relative to the threshold amount.

In FIG. 11B, the meter 454A indicates that six spins remain until the terminating event occurs (i.e., four plays of the wagering game have been conducted). The meter 454B indicates that 250 credits were achieved on the prior spin of the wagering game and the meter 454C indicates that the aggregate amount of credits awarded since the triggering event is 800 credits. Because the aggregate award amount indicated by the meter 454C is less than the threshold amount indicated by the meter 454D, the meter 454E still indicates that the "3×" multiplier can be but has not yet been achieved. As the 250 credits for the prior spin were awarded, the indicator 454F can show an animation of gold coins dropping into the pot. The volume of gold coins within the pot after the animation relative to the volume of the pot provides a graphical representation of the aggregate amount relative to the threshold amount. For example, the gold coins can fill 80% of the pot to represent that the aggregate amount is 800 relative to the threshold amount being 1000.

In FIG. 11C, the meter 454A indicates that 2 spins remain until the terminating event occurs. The meter 454B indicates that 100 credits were awarded for the prior spin of the wagering game and the meter 454C indicates that the aggregate amount of credits is 1050 credits. Because the aggregate amount now exceeds the threshold amount, the meter 454E indicates that the "3×" multiplier has been activated. Additionally, the indicator 454F depicts the gold coins overflowing above the top surface of the pot.

Figure 12:
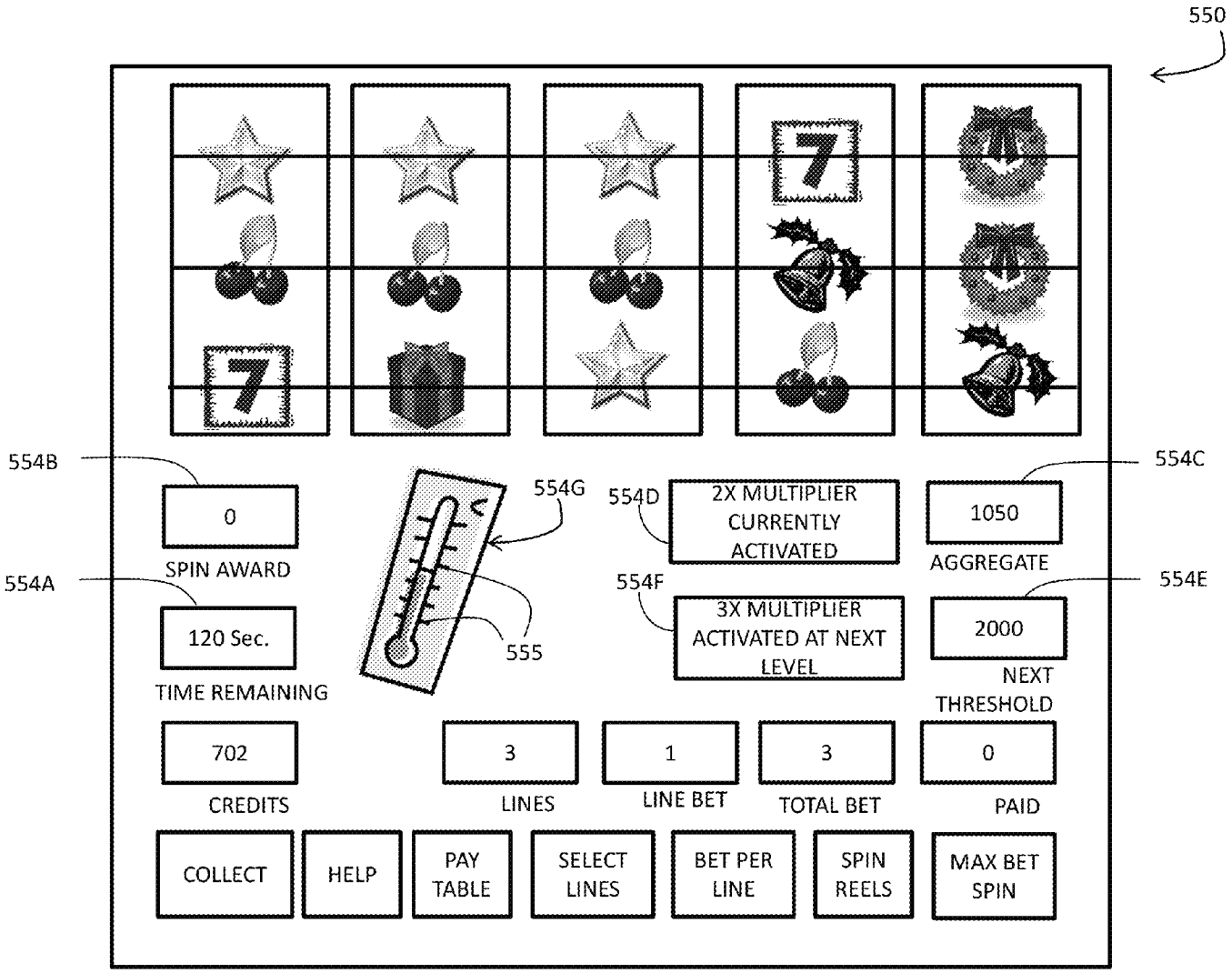
FIG. 12 is an image of an exemplary wagering game screen displayed on a gaming terminal, according to an embodiment of the present invention.

While the exemplary embodiment illustrated and described for FIGS. 11A-11C included numerical indicators 454C, 454E and a graphical image indicator 454F, it is contemplated that, according to some aspects, only numerical indicator(s) or only graphical indicator(s) may be provided. Additionally, it should be understood that other types of indicators can be provided. For example, FIG. 12 illustrates a wagering game screen 550 including additional indicators for informing a player as to their progress towards achieving one or more game enhancements. The wagering game screen 550 includes a meter 554A that indicates an amount of time remaining until the terminating event occurs, a meter 554B that indicates the award amount awarded on the prior play of the wagering game, a meter 554C that indicates the aggregate award amount, and a meter 554D that indicates a game enhancement that has been activated (if any). The wagering game being played in this example includes a plurality of threshold amounts that are each associated with a different game enhancement. To inform a player as to their status within the wagering game, a meter 554E indicates the number of credits needed to achieve the next threshold amount, and a meter 554F indicates a game enhancement that can be activated if the aggregate amount exceeds the next threshold amount.

Additionally, the exemplary wagering game screen 550 includes a graphical image indicator 554G that is configured to provide an indication as to the aggregate amount relative to each of the plurality of threshold amounts. In the illustrated example, the graphical image is a thermometer including a plurality of temperature lines 555 that each correspond to one of the threshold amounts. As the aggregate amount increases, an animation of mercury rising within the thermometer is shown. The position of the mercury provides a graphical representation of the aggregate amount relative to the threshold amounts. The mercury rises above a temperature line when the aggregate amount exceeds the associated threshold amount.

It should be understood that the indicators illustrated in FIGS. 11A-12 are merely examples. It is contemplated that other numerical and/or graphical image indicators can be provided. For example, a graphical indicator can include rising lava within a volcano, a racer running towards a finish line, a sun rising above the horizon, and/or a boat sailing around the globe.

FIGS. 4, 6 and 10, described by way of example above, represent exemplary algorithms that correspond to at least some instructions executed by the CPU 30 in FIG. 2 to perform the above described functions associated with the disclosed concepts. It is also within the scope and spirit of the present concepts to omit steps, include additional steps, and/or modify the order of steps presented above. As one non-limiting example, the determination of the aggregate award amount at block 218 can be performed after it is determined that the second event has occurred at block 220 and prior to the determination of whether the aggregate award amount is greater than the threshold amount at block 222.

While in the embodiments described above, the wagering game included a slot type wagering game, it should be understood that the wagering game can additionally or alternatively include other wagering games, such as video poker, video black jack, video lottery, etc., in whole or part. Additionally, for purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may involve wagers of real money, as found with typical land-based or on-line casino games. In other embodiments, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

The invention claimed is:

1. A method of operating a gaming system, the gaming system including a random element generator, one or more controllers, and a gaming machine, the gaming machine primarily dedicated to playing at least one casino wagering game, the gaming machine including a gaming cabinet, an electronic display device, and an electronic input device, the gaming cabinet constructed to house components associated with the casino wagering game, the electronic display device and the electronic input device being coupled to the gaming cabinet, the method comprising:

generating one or more random elements with the random element generator;

receiving, via a physical input to the electronic input device, a wager input to initiate a base play of the casino wagering game;

determining, via at least one of the one or more controllers, whether a triggering event has occurred;

in response to determining that a triggering event has occurred during the base play and without requiring additional wager input, activating, by the one or more controllers, a threshold-based enhancement functionality during which a plurality of successive bonus plays of the casino wagering game are conducted;

displaying respective outcomes of the successive bonus plays on the electronic display device, the outcomes being based, at least in part, on the one or more random elements, the respective outcomes being displayed in the form of a plurality of symbols along one or more paylines in a display area;

for each of initial ones of the successive bonus plays, determining, via at least one of the one or more controllers, one or more award amounts based on the outcomes of the initial ones of successive bonus plays;

aggregating, via at least one of the one or more controllers, each of the one or more award amounts determined over the initial ones of the successive bonus plays to calculate an aggregate award amount;

determining, via at least one of the one or more controllers, whether the aggregate award amount is greater than a threshold amount;

providing an enhancement to remaining ones of the successive bonus plays in response to the aggregate award amount being greater than the threshold amount;

determining, by at least one of the one or more controllers, whether a terminating event has occurred, the plurality of successive bonus plays being conducted until it is determined that the terminating event has occurred; and enhancing, by at least one of the one or more controllers, the aggregate amount based on the enhancement in response to determining that the terminating event has occurred and the aggregate amount is greater than the threshold amount.

2. The method of claim 1, wherein the triggering event is a gameplay-related event.

3. The method of claim 1, wherein the triggering event is based on a turnover amount over a plurality of base plays of the casino wagering game.

4. The method of claim 1, wherein the wager input is indicative of a wager amount, the threshold amount being determined based on the wager amount.

5. The method of claim 1, further comprising determining, by at least one of the one or more controllers, the enhancement from a plurality of potential enhancements based on the triggering event.

6. The method of claim 1, wherein the threshold value is determined prior to the triggering event.

7. The method of claim 1, wherein the threshold amount comprises a plurality of threshold levels and the enhancement comprises a plurality of enhancement levels, each of the plurality of enhancement levels being associated with a respective one of the plurality of threshold levels, the determining whether the aggregate amount is greater than the threshold amount including comparing the aggregate amount to the plurality of threshold levels, the providing the enhancement including providing at least one of the plurality of enhancement levels based on the comparing of the aggregate amount to the plurality of threshold levels.

8. The method of claim 1, further comprising:

in response to the providing the enhancement, conducting one or more further bonus plays of the casino wagering game; and determining, by at least one of the one or more controllers, one or more second award amounts based on the conducting of the one or more further bonus plays of the casino wagering game and the enhancement.

9. The method of claim 8, wherein the enhancement is a wild symbol.

10. The method of claim 1, wherein the enhancement is a multiplier.

11. A method of operating a gaming system, the gaming system including a random element generator, one or more controllers, and a gaming machine, the gaming machine primarily dedicated to playing at least one casino wagering game, the gaming machine including a gaming cabinet, an electronic display device, and an electronic input device, the gaming cabinet constructed to house components associated with the casino wagering game, the electronic display device and the electronic input device being coupled to the gaming cabinet, the method comprising:

generating one or more random elements with the random element generator;

receiving, via a physical input to the electronic input device, a wager input indicative of a wager to initiate the casino wagering game;

determining, via at least one of the one or more controllers, whether a triggering event has occurred;

in response to determining that a triggering event has occurred, activating, by the one or more controllers, a threshold-based enhancement functionality during which a randomly selected outcome is determined, the randomly selected outcome being based, at least in part, on the one or more random elements;

displaying, on the electronic display device, a plurality of symbols along one or more paylines to indicate the randomly selected outcome of the casino wagering game in a display area;

determining, via at least one of the one or more controllers, two or more award amounts for the one or more paylines, each award amount being based on the wager and the symbols of the randomly selected outcome along a respective one of the one or more paylines;

determining, via at least one of the one or more controllers, an aggregate award amount based on the two or more award amounts;

comparing, via at least one of the one or more controllers, the aggregate award amount to a threshold amount; and applying, via at least one of the one or more controllers, an enhancement to the aggregate award amount based on the comparing of the aggregate award amount and the threshold amount.

12. The method of claim 1, further comprising displaying, on the electronic display device, an indicator indicating the aggregate amount relative to the threshold amount.

13. The method of claim 12, wherein the indicator is a graphical indication of the aggregate amount relative to the threshold amount.

14. The method of claim 11, further comprising:

receiving, via another physical input to the electronic input device, a second wager input indicative of a second wager;

displaying, on the electronic display device, a second plurality of symbols along at least one of the one or more paylines to indicate a second randomly selected outcome of the casino wagering game in the display area;

determining, via at least one of the one or more controllers, one or more second award amounts for the at least one or more paylines based on the second wager and the symbols of the second randomly selected outcome;

determining, via at least one of the one or more controllers, a second aggregate award amount based on the one or more award amounts and the one or more second award amounts;

comparing, via at least one of the one or more controllers, the second aggregate award amount to the threshold amount; and initiating the enhancement to the second aggregate award based on the comparing of the second aggregate award amount and the threshold amount.

15. The method of claim 11, further comprising:

determining, by at least one of the one or more controllers, whether a terminating event has occurred, the randomly selected outcome being determined prior to determining that the terminating event has occurred; and enhancing, by at least one of the one or more controllers, the aggregate award amount based on the enhancement in response to determining that the terminating event has occurred and the aggregate award amount is greater than the threshold amount.

16. The method of claim 15, wherein the enhancement is a multiplier.

17. A gaming system, comprising:

a gaming machine primarily dedicated to playing at least one casino wagering game the gaming machine including a gaming, an electronic display device, and an electronic input device, the cabinet constructed to house components associated with the casino wagering game, the electronic display device and the electronic input device being coupled to the gaming cabinet, the electronic input device configured to receive a physical input from a player to initiate the casino wagering game and transform the input into an electronic data signal;

a random element generator configured to generate one or more random elements; and one or more controllers configured to:

initiate the casino wagering game in response to the electronic data signal from the electronic input device of the gaming machine;

determine whether a triggering event has occurred;

in response to determining that a triggering event has occurred, activate a threshold-based enhancement functionality during which one or more randomly selected outcomes of the casino wagering game are determined, the one or more randomly selected outcomes being based, at least in part, on the one or more random elements;

display, on the electronic display device, a plurality of symbols along one or more paylines to indicate the one or more randomly selected outcomes of the casino wagering game in a display area;

evaluate each of the one or more randomly selected outcomes to determine two or more award amounts;

aggregate the two or more award amounts to determine an aggregate award amount;

determine whether the aggregate award amount is greater than a threshold amount; and if the aggregate award amount is determined to be greater than the threshold amount, provide an enhancement to the aggregate award amount.

18. The system of claim 17, wherein the one or more processors further cause the game to display, on the electronic display device, an indicator indicating the aggregate award amount relative to the threshold amount.

19. The system of claim 17, wherein the one or more randomly selected outcomes are displayed during a free-spins event.

20. The system of claim 17, wherein the threshold amount is a multiple of at least one of the one or more wagers.

21. The gaming system of claim 17, further comprising:

determining, by at least one of the one or more controllers, whether a terminating event has occurred, the one or more randomly selected outcomes being determined prior to determining that the terminating event has occurred; and enhancing, by at least one of the one or more controllers, the aggregate award amount based on the enhancement in response to determining that the terminating event has occurred and the aggregate award amount is greater than the threshold amount.

22. The gaming system of claim 21, wherein the enhancement is a multiplier.

* * * * *